US011786028B2

(12) United States Patent
Byun

(10) Patent No.: US 11,786,028 B2
(45) Date of Patent: Oct. 17, 2023

(54) COSMETIC CONTAINER

(71) Applicant: Sung Jin Cosmetics Co., Ltd., Seoul (KR)

(72) Inventor: Young-Kwang Byun, Seoul (KR)

(73) Assignee: Sung Jin Cosmetics Co., Ltd., Seoul (KR)

( * ) Notice: Subject to any disclaimer, the term of this patent is extended or adjusted under 35 U.S.C. 154(b) by 626 days.

(21) Appl. No.: 16/892,203

(22) Filed: Jun. 3, 2020

(65) Prior Publication Data

US 2021/0169199 A1 Jun. 10, 2021

(30) Foreign Application Priority Data

Dec. 6, 2019 (KR) ..... 10-2019-0161852
Mar. 30, 2020 (KR) ..... 10-2020-0038363

(51) Int. Cl.
*A45D 33/02* (2006.01)
*A45D 33/00* (2006.01)

(52) U.S. Cl.
CPC ..... *A45D 33/02* (2013.01); *A45D 33/006* (2013.01); *A45D 2200/05* (2013.01)

(58) Field of Classification Search
CPC .... A45D 33/00; A45D 33/003; A45D 33/006; A45D 33/02; A45D 33/025; A45D 33/04; A45D 33/06; A45D 33/10; A45D 33/14; A45D 33/16; A45D 33/36; A45D 34/042; A45D 34/043; A45D 40/02; A45D 40/026; A45D 40/06; A45D 40/10; A45D 40/18; A45D 2200/00; A45D 2200/05; A45D 19/02; A45D 24/26; A45D 24/28; A45D 27/04; A46B 11/001; A46B 11/002; A46B 11/0031; A46B 11/0041; A46B 11/0055; A46B 11/0072
See application file for complete search history.

(56) References Cited

U.S. PATENT DOCUMENTS 3,132,653 A * 5/1964 Gazdik ..... A45D 40/24 229/125.17
8,651,763 B2 * 2/2014 Byun ..... A46B 7/023 401/268
2007/0098485 A1 * 5/2007 Byun ..... A45D 33/34 401/117
2007/0151571 A1 * 7/2007 Byun ..... A45D 24/24 132/108
2010/0260532 A1 * 10/2010 Tsai ..... A46B 17/04 401/269

(Continued)

FOREIGN PATENT DOCUMENTS

KR 10-1313743 B1 5/2013

*Primary Examiner* — Cris L. Rodriguez
*Assistant Examiner* — Karim Asqiriba
(74) *Attorney, Agent, or Firm* — KAPLAN BREYER SCHWARZ, LLP

(57) ABSTRACT

There is provided a cosmetic container which is easy to manufacture with a simplified configuration and capable of performing discharging and blocking of powder in a reliable manner and preventing the powder from leaking out. The cosmetic container includes a container body in which the powder is accommodated, and a brush part coupled to an upper end of the container body and provided with an opening/closing part provided therein to selectively discharge the powder and a powder brush provided in an upper end of the brush part.

8 Claims, 12 Drawing Sheets

(56) References Cited

U.S. PATENT DOCUMENTS

| | | | | |
|---|---|---|---|---|
| 2015/0225165 | A1* | 8/2015 | Bloc | A45D 34/04 222/344 |
| 2015/0230587 | A1* | 8/2015 | Chan | A45D 34/046 401/55 |
| 2016/0360855 | A1* | 12/2016 | Byun | A45D 34/04 |
| 2019/0008260 | A1* | 1/2019 | Wilson | A45D 34/042 |
| 2019/0231051 | A1* | 8/2019 | Sog | A45D 34/042 |

* cited by examiner

COSMETIC CONTAINER

CROSS-REFERENCE TO RELATED APPLICATION

This application claims priority to and the benefit of Korean Patent Application No. 10-2019-0161852 filed in the Korean Intellectual Property Office on Dec. 6, 2019, and Korean Patent Application No. 10-2020-0038363 filed in the Korean Intellectual Property Office on Mar. 30, 2020, the entire contents of which are incorporated herein by reference.

BACKGROUND OF THE INVENTION

(a) Field of the Invention

The present disclosure relates to a cosmetic container.

(b) Description of the Related Art

For example, a powder type of cosmetic is filled and stored in a container, and is used by discharging a certain amount of contents from the container at the time of putting on makeup. In general, the powder type of cosmetic is applied on the skin by using a brush.

In recent years, a cosmetic container having a brush integrally provided therein has been developed for more convenient usage. The cosmetic container having such an integrated brush includes an opening/closing device for selectively opening and closing a gap between the brush and a powder accommodation space. Thus, the powder can be supplied to the brush by opening the opening/closing device if necessary. When the cosmetic container is not in use, the discharge of the powder can be prevented by closing the opening/closing device.

The present inventors have developed a cosmetic container having a reduced number of parts and a simplified configuration, which is improved in configuration as compared with a conventional opening/closing device. Korean Registration Patent No. 10-1313743 as a patent registration document discloses a cosmetic container which has been developed by the present inventors.

As the usage of the powder type of cosmetic gradually increases, there is an increasing requirement for cosmetic container with a simplified configuration and improved usability, which is capable of performing discharging and blocking of the powder in a reliable manner. In this regard, providing a more advanced cosmetic container to meet such a requirement and an intensely competitive market provides a number of benefits to the user.

SUMMARY

Problem to be Solved

The object of the present disclosure is to provide a cosmetic container which is easy to manufacture with a relatively simplified configuration.

The object of the present disclosure is to provide a cosmetic container of which an opening/closing device is convenient to use.

The object of the present disclosure is to provide a cosmetic container which is capable of ensuring discharging and blocking of powder and preventing the powder from leaking out.

Solution to Problem

A cosmetic container of the present embodiment may include a container body in which a powder is accommodated, and a brush part coupled to an upper end of the container body, and including a powder brush provided therein.

The cosmetic container may further include an opening/closing part coupled to the upper end of the container body and provided therein to selectively discharge the powder.

The cosmetic container may further include an air injection part provided in a lower end of the container body to forcibly inject the powder into the brush part.

The cosmetic container may further include a cap detachably coupled to an upper end of the brush part to cover the powder from the outside.

The opening/closing part may include: a housing coupled to the upper end of the container body to form constitute an outer shape of the opening/closing part and having at least one or more discharge holes, through which the powder is discharged, and formed at a lower end of the housing along a circumferential direction with respect to a central axis; a rotational body rotatably provided inside the housing while being coaxially coupled to the housing, and having transfer holes formed at a lower end of the rotational body, wherein the powder brush is provided in an upper end of the rotational body, the powder is supplied into the powder brush through the transfer holes which are in communication with the discharge holes, and the rotational body configured to rotate relative to the housing so that the transfer holes and the discharge holes are in a selective communication with each other or positionally deviated from each other; and a sleeve provided between the housing and the rotational body to slidably move upward and downward relative to the housing, wherein the rotational body is rotated clockwise and counterclockwise with the upward and downward movement of the sleeve, and the discharge holes and the transfer holes are brought into the selective communication with each other with the upward/downward movement of the sleeve.

The opening/closing part may further include elastic pieces which are formed in a lower portion of the sleeve and are brought into close contact with the rotational body in an elastic manner, and lock pockets which are formed in the upper portion of the rotational body such that the elastic pieces are locked into the respective lock pockets when the sleeve is raised to the highest position.

The opening/closing part may include: vertical grooves and protrusions formed between an inner peripheral surface of the housing and an outer peripheral surface of the sleeve so as to face each other and be engaged with each other, wherein the protrusions configured to move along the vertical grooves; and cam grooves and cam protrusions formed between an outer peripheral surface of the rotational body and an inner peripheral surface of the sleeve so as to face each other and be engaged with each other, wherein the cam protrusions configured to move along the cam grooves. The vertical grooves may be formed to linearly extend along an axial direction so that the sleeve is vertically moved upward and downward relative to the housing, and the cam grooves may be formed to extend in the axial direction and are formed obliquely with respect to the axial direction to deviate both leading ends of each of the cam grooves from each other in a circumferential direction, so that the rotational body is rotated in the circumferential direction with the upward/downward movement of the sleeve.

Each of the cam grooves may include an inclined portion formed obliquely with respect to the axial direction, and linear portions extending from the inclined portion in the axial direction to constitute the both leading ends of each of the cam grooves.

Each of the cam grooves may be configured to be formed in a spiral shape along the axial direction.

The rotational body may include a rotational shaft formed on the lower end thereof to protrude along the central axis. An insertion hole into which the rotational shaft is inserted may be formed in the lower end of the housing. The rotational shaft may have a recessed portion formed to protrude outward along an outer peripheral surface of the rotational shaft. The rotational shaft may have a groove portion formed along an inner peripheral surface thereof such that the protrusion is locked into the groove portion. The recessed portion may be fitted into and coupled to the groove portion.

The cosmetic container may further include a sealing part tightly provided between the rotational body and the housing so as to prevent a gap from being generated between the discharge holes and the transfer holes.

The sealing part may include a polygonal sealing pad coupled to the rotational body by being inserted to a rotational shaft, and guide bars formed to protrude from the lower end of the rotational body and configured to regulate a rotation of the sealing pad, the polygonal sealing pad having holes formed at positions corresponding to the transfer holes.

The sealing pad may have a flesh portion formed to have an increased thickness in a peripheral portion of the sealing pad or around the holes, so that the sealing pad is brought into tight contact with surfaces of the rotational body and the housing through the flesh portion.

The cosmetic container may further include a filter provided below the discharge holes of the housing and configured to filter the powder to be discharged through the discharge holes.

The filter may be a single sheet structure with a grid-like pattern.

The air injection part may include: a holder provided in an opened portion of the lower end of the container body; a cover provided on an upper end of the holder; an air tube, through which air is transferred, formed on the cover to extend toward an upper portion of the container body; a button provided in a lower end of the holder to protrude outwardly so that the button is pressed externally; an elastic member provided between an inner wall of the holder and the button to apply an elastic resilience with respect to the button; and a check valve provided on an upper end of the air tube and configured to inject the air toward the discharge holes of the container body by being opened and closed by an air pressure, generated with the operation of the button, in the air tube.

The cosmetic container may further include a piston member provided in the button and having a skirt portion whose outer diameter is increased as it goes upward so that the piston member is brought into close contact with an inner peripheral surface of the holder in an elastic manner.

The check valve may be formed of an elastic material. A lower end of the check valve may be opened to be in communication with the air tube. The check valve may be formed in a tapered conical shape having both membranes which are gradually reduced in thickness upward, and may have a configuration in which a slit-liked cut line is formed in an upper end of the check valve as a tip portion, and the both membranes are in contact with each other through the cut line.

The air injection part includes: a holder provided at the lower end of the container body; a button supported by the holder, having a lower end protruding outward, and provided to protrude outwardly to be pressed externally; and a pumping member provided in a resilient manner between the container body and the button, having an upper portion extending toward discharge holes of the container body and an internal space formed to allow an air to flow thereinto, and configured to be elastically deformed by a pressing force of the button and inject the air inside the pumping member toward the discharge holes of the container body.

The pumping member includes: an elastic deformation portion provided to be elastically deformed when the button is pushed, configured to apply a pressure to the inside of the pumping member so as to discharge outward the air inside of the pimping member, and configured to apply an elastic force for returning the button to its original position; an upper pad integrally formed on an upper portion of the elastic deformation portion and formed to protrude outward so that the upper pad is brought into close contact with an inner flange formed on an inner surface of the container body; a lower pad integrally formed on a lower portion of the elastic deformation portion and formed to protrude outward so that the lower pad is brought into close contact with an upper end of the button; an insertion portion integrally formed on the lower portion of the elastic deformation portion, communicating with an inside of the elastic deformation portion, extending downward from the lower pad, having a cylindrical shape with an opened lower end, and provided to be inserted into the button so that the insertion portion is brought into close contact with an inner peripheral surface of the button in an elastic manner; an air tube integrally formed on the upper portion of the elastic deformation portion, formed to extend upward along an axial direction, and communicating with the inside of the elastic deformation portion to convey the air; and a check valve integrally formed on an upper end of the air tube, configured to be opened and closed by an internal air pressure so that the air is injected outward from the inside of the air tube.

The pumping member may be formed of a material such as silicon, rubber, or the like.

The insertion portion may include a fitting portion fitted to an inner surface of the button, and a skirt portion formed to extend downward from the fitting portion, and having an outer diameter becoming larger downward.

The check valve may be integrally formed on the upper end of the air tube and may be formed in a tapered conical shape having both membranes which are gradually reduced in thickness upward. The check valve may have a configuration in which a slit-liked cut line is formed in an upper end of the check valve as a tip portion, and the both membranes are in contact with each other through the cut line.

The button may be fitted to and coupled to the insertion portion of the pumping member through an opened upper portion of the button, and may be provided to protrude outward through a hole formed in the holder. The button may include a flange formed on an upper portion thereof to protrude outward so as to be engaged with the hole, and at least one or more trench grooves formed at intervals in an upper end in contact with the lower pad of the pumping member to introduce the air into the inside of the button through gap formed between the button and the lower pad.

The at least one or more trench grooves may be formed to extend along an inner circumferential surface of the button at the upper portion of the button.

The container body may include an inner flange formed on an inner peripheral surface thereof to protrude toward a center. The air tube of the pumping member may extend upward through a central hole of the inner flange, and the upper pad of the pumping member may be brought into close contact with a lower end of the inner flange.

The pumping member may further include a stepped member spaced apart from the upper pad and formed to protrude outward of the air tube. The stepped member may be brought into close contact with an upper end of the inner flange. The pumping member may be coupled with the inner flange while the inner flange is fitted between the stepped member and the upper pad.

An outer diameter of the air tube positioned between the stepped member and the upper pad may be set greater than or equal to an inner diameter of the central hole of the inner flange.

The gap between the stepped member and the upper pad may be set smaller than or equal to a thickness of the inner flange.

An upper end of the stepped member may form an inclined surface whose diameter becomes smaller as it goes upward.

A distance between the upper pad and the lower pad may be larger than that between the inner flange and the upper end of the button in a state in which the button is not pushed.

Effects of the Present Disclosure

According to the present disclosure in some embodiments, it is possible to provide advantages of more easily using a cosmetic container with a simplified configuration, and of being easy to manufacture the cosmetic container.

Accordingly, it is possible to achieve a reduction in manufacturing costs through the easy-to-manufacture, thus improving price competitiveness of the product.

Further, it is possible to ensure blocking and opening of powder supply holes and prevent the powder from leaking out from the cosmetic container even if the cosmetic container is in use for a long period of time.

Further, it is possible to minimize a phenomenon that clogging of the powder supply holes is generated and more effectively supply the powder.

DETAILED DESCRIPTION

Figure 1:
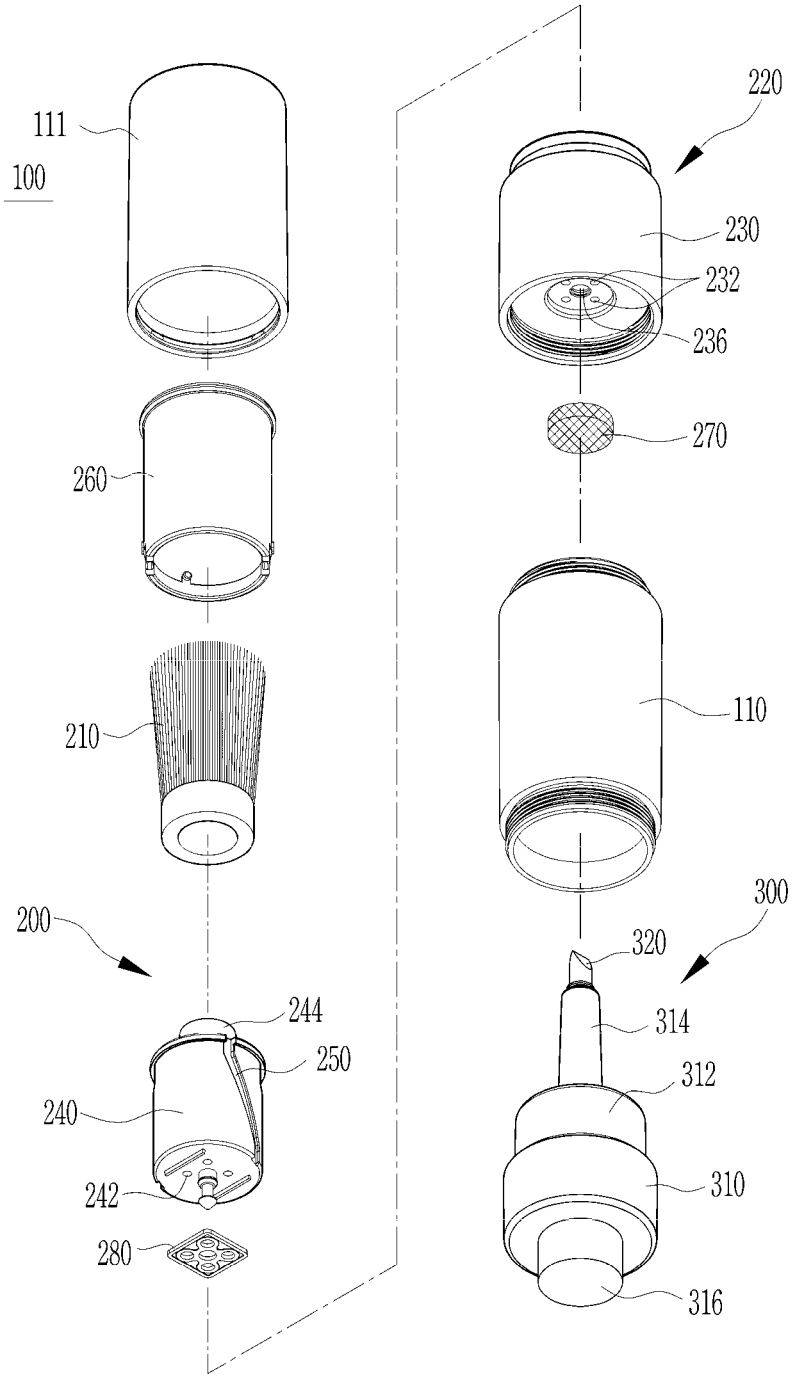
FIG. 1 is a schematic exploded perspective view illustrating a configuration of a cosmetic container according to an embodiment.

Hereinafter, embodiments of the present invention will be described in detail. However, the embodiments are exemplary in all respects and are not restrictive. The present disclosure is merely defined by the scope of the appended claims. The embodiments described below may be modified in various forms without departing from the spirit and scope of the appended claims. In all the accompanying drawings, the same or similar components will be denoted by the same reference numerals.

The technical terms used herein are merely referred to specific embodiments and are not intended to limit the present disclosure. The singular terms used herein also include the plural terms unless the terms clearly represent the opposite meanings. The meaning of "includes" used herein refers to include certain characteristics, regions, integers, steps, operations, elements, and/or components and does not means that the presence or addition of other certain characteristics, regions, integers, steps, operations, elements, components, and/or groups is excluded.

Figure 2:
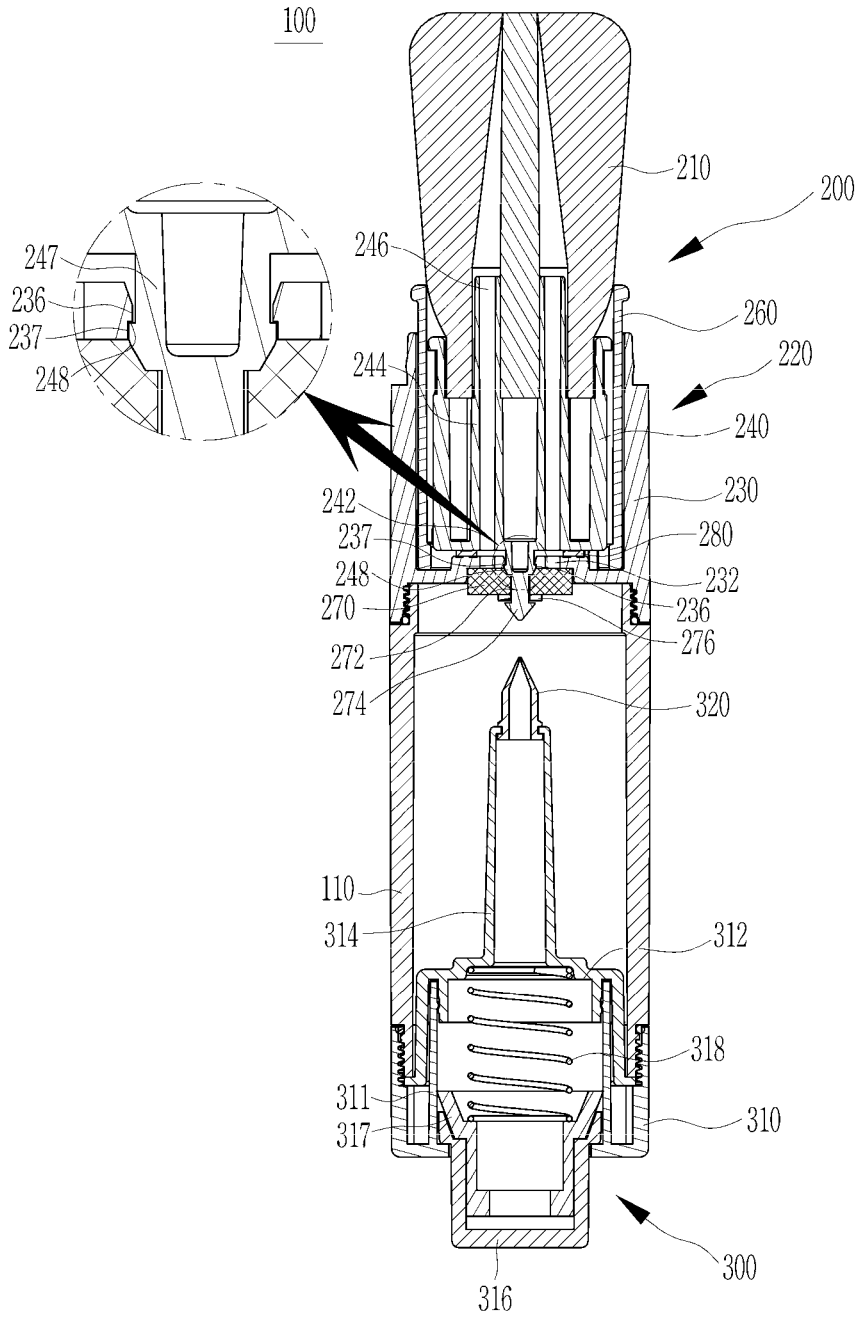
FIG. 2 is a schematic cross-sectional view illustrating an assembled state of the cosmetic container according to the embodiment.

FIG. 1 illustrates a configuration of a cosmetic container according to the present embodiment, and FIG. 2 illustrates an assembled configuration of the cosmetic container.

In the following description, an axial direction refers to a direction in which the central axis line passes, and is defined as a Y-axis direction in FIG. 2. Above, an upper portion or an upward direction used herein refers to a direction oriented upward in the Y-axis direction when a powder brush is oriented upward as in FIG. 2, and below, a lower portion or a downward direction refers to a direction opposite the upward direction.

As shown in FIGS. 1 and 2, a cosmetic container 100 according to the present embodiment may include a container body 110, a brush part 200, and an air injection part 300.

Figure 7:
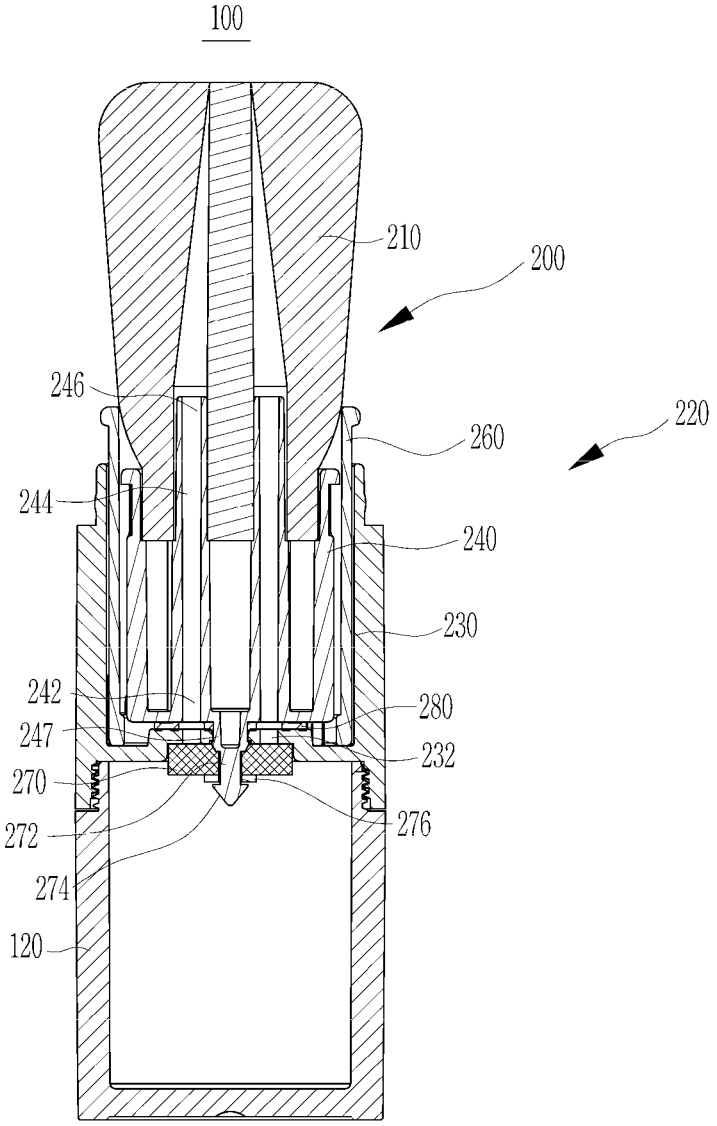
FIG. 7 is a schematic cross-sectional view of a cosmetic container according to another embodiment.
Figure 8:
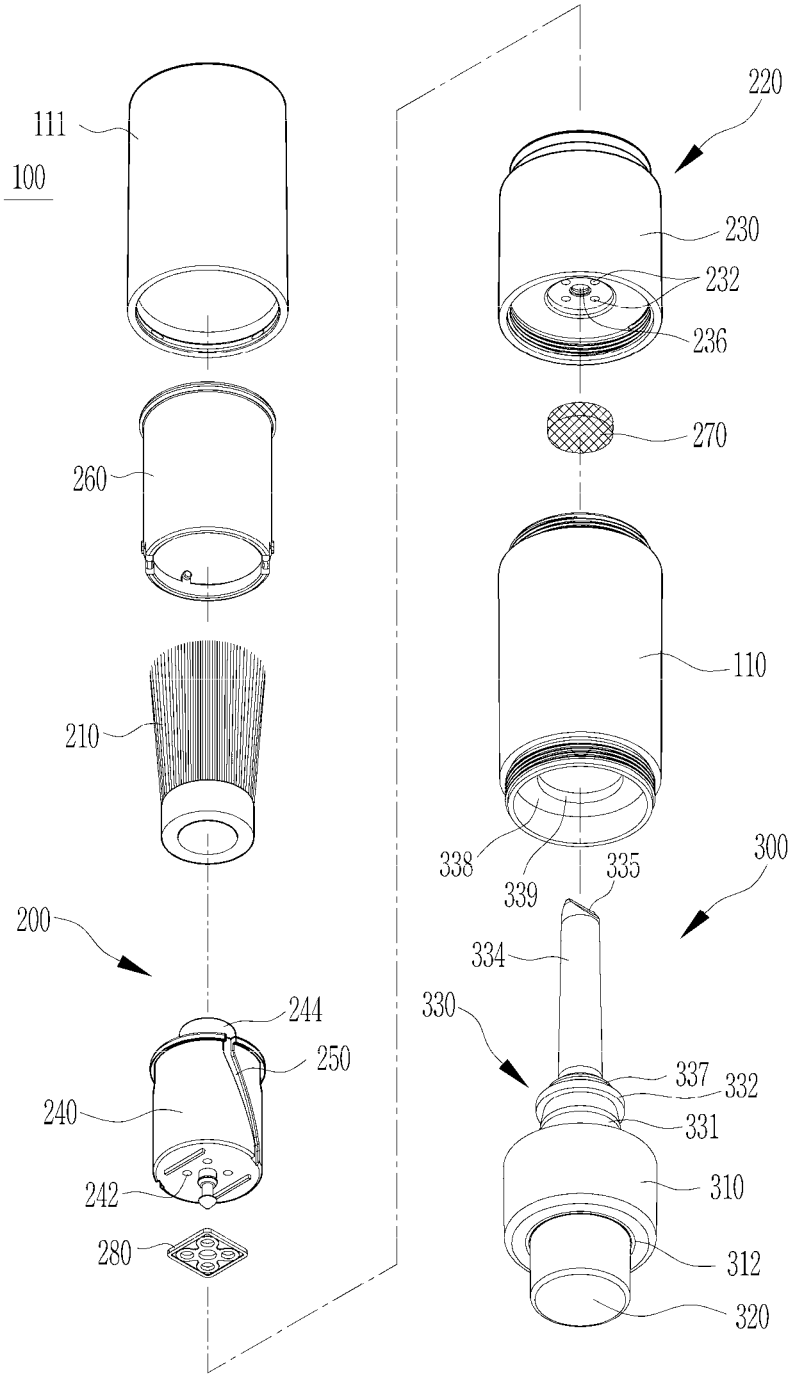
FIG. 8 is a schematic exploded perspective view illustrating a configuration of a cosmetic container according to another embodiment.
Figure 9:
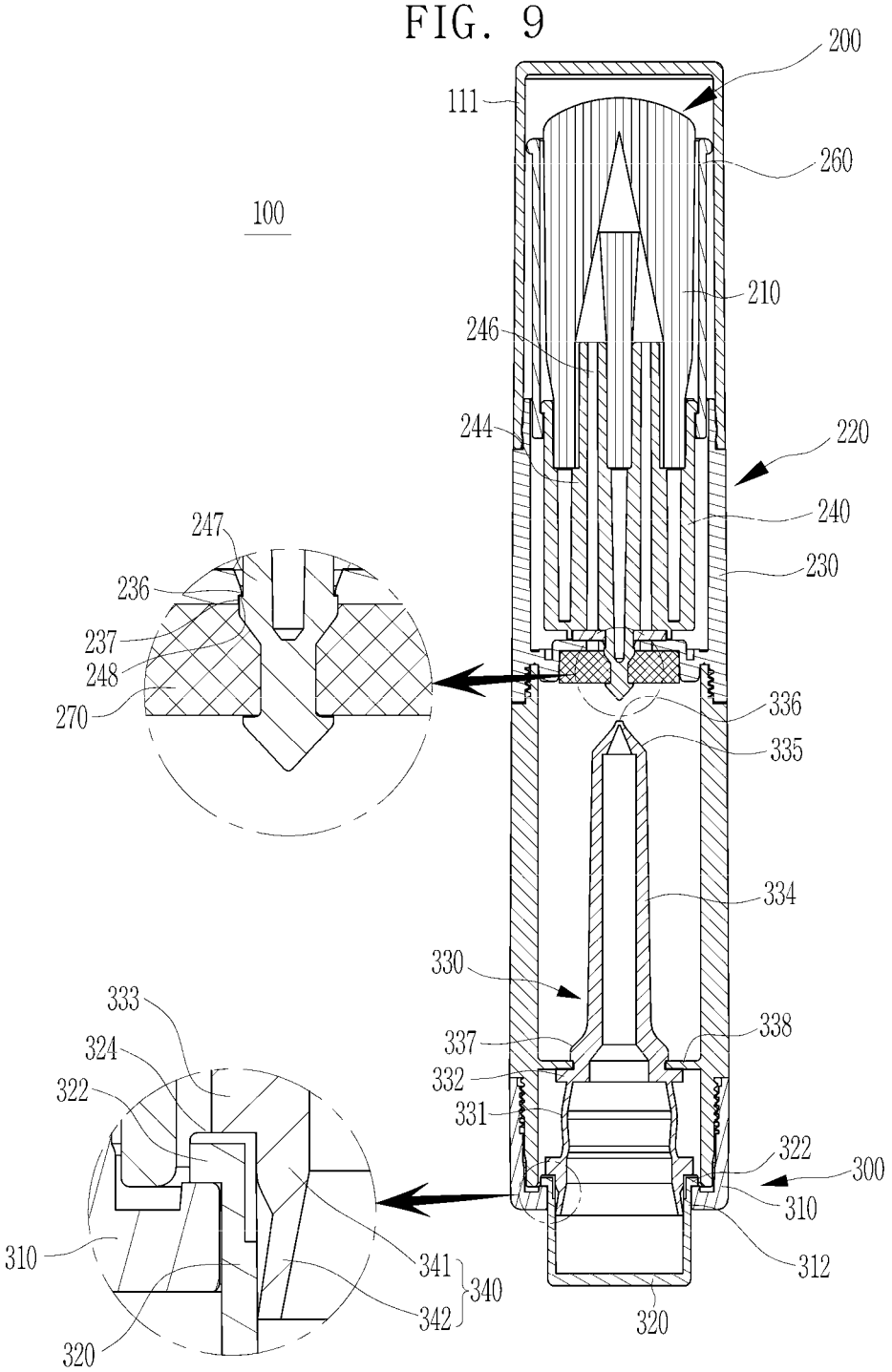
FIG. 9 is a schematic cross-sectional view illustrating an assembled state of the cosmetic container according to the embodiment of FIG. 8.

Further, FIG. 7 illustrates another embodiment of the cosmetic container 100. A cosmetic body 120 shown in FIG. 7 is identical in structure to the cosmetic container 100 according to the embodiment of FIG. 1, except that the cosmetic body 120 of FIG. 7 has a container configuration in which a lower end thereof is closed and an air injection part (see reference numeral 300 in FIG. 1) is not provided. In FIG. 7, the same reference numerals denote the same configurations as those in FIG. 1, and a detailed description thereof will be omitted.

Hereinafter, the cosmetic container 100 according to the present embodiment will be described with reference to FIG.

1, and the description of the cosmetic container 100 according to another embodiment of FIG. 7 will be omitted to avoid duplication.

As shown in FIG. 1, the container body 110 may have a cylindrical shape with an accommodation space defined therein. Cosmetic (hereinafter referred to as powder) in the form of a powder is filled into the accommodation space of the container body 110. The shape of the container body 110 may be modified in various forms.

The container body 110 has a cylindrical configuration in which upper and lower ends are opened. The brush part 200 may be coupled to an upper end of the container body 110, and the air injection part 300 may be coupled to a lower end of the container body 110. The powder accommodated in the container body 110 is used by being discharged to the brush part 200. The size and shape of the container body 110 may be changed in various sizes and shapes.

The brush part 200, which is coupled to the upper end of the container body 110, includes an opening/closing part 220 provided therein and configured to selectively discharge the powder therethrough. A powder brush 210 is provided on an upper end of the brush part 200.

The cosmetic container 100 of the present embodiment may further include a cap 111 that is detachably coupled to the upper end of the brush part 200 to block the powder brush 210 from the outside. The cap 111 may be coupled to the brush part 200 to cover the powder brush 210 and protect the powder brush 210 from the outside. The powder brush 210 is a part configured to make gentle contact with the skin at the time of putting on makeup, and may be provided in a variety of other forms, such as a brush shape, a porous sponge shape and the like.

The opening/closing part 220 connects or disconnects between the container body 110 and the brush part 200 to selectively discharge the powder accommodated in the container body 110 to the powder brush 210.

The opening/closing part 220 of the present embodiment may include a housing 230 with discharge holes 232 formed therein, a rotational body 240 with transfer holes 242 formed therein, and a sleeve 260 provided between the housing 230 and the rotational body 240.

The housing 230 may be a cylindrical structure with an opened upper end. The housing 230 may be coupled to the upper end of the container body 110 to form an outer shape of the cosmetic container 100 in combination with the container body 110. As an example, the housing 230 may be formed to have the same outer diameter as that of the container body 110.

The housing 230 may be detachably coupled to the upper end of the container body 110. For example, a male screw and a female screw may be formed on the upper end of the container body 110 and the lower end of the housing 230, respectively, so that they are threadedly coupled to each other. The brush part 200 may be coupled to the container body 110 in various manners other than the threadedly-coupling manner, but is not particularly limited thereto. The cap 111 may be detachably coupled to the upper end of the housing 230.

The discharge holes 232 are formed in the bottom surface of the housing 230 in a communication relationship with the container body 110 to discharge the powder therethrough. The discharge holes 232 may be arranged along a circumference direction at intervals around an axis coinciding with the center of the housing 230. In the present embodiment, four discharge holes 232 may be arranged at an interval of 90 degrees. The number, size and position of discharge holes 232 may be variously changed. Vertical grooves (see reference numeral 234 in FIG. 4) are formed in an inner peripheral surface of the housing 230 to linearly extend along the axial direction. The vertical grooves 234 are grooves used when being coupled to the sleeve 260. Details thereof will be described again later.

The rotational body 240 is a cylindrical structure with an opened upper end and is inserted into the housing 230. The transfer holes 242 through which the powder is discharged are formed in the bottom surface of the lower end of the rotational body 240 in a communication relationship with the discharge holes 232 formed in the housing 230. The transfer holes 242 are arranged to correspond to the respective discharge holes 232 such that the transfer holes 242 and the discharge holes 232 are in communication with each other.

The rotational body 240 may be coaxially coupled to the bottom surface of the housing 230 so as to be rotatably mounted relative to the housing 230. Thus, the rotational body 240 rotates relative to the housing 230 so that the discharge holes 232 can be opened or closed. When the rotational body 240 is rotated, the transfer holes 242 of the rotational body 240 are moved relative to the discharge holes 232 stating in a fixed state so that the transfer holes 242 are aligned with the respective discharge holes 232 to be in communication with each other, or so that the transfer holes 242 are positionally deviated from the discharge holes 232 to be not in communication with each other. Thus, the discharge holes 232 can be opened by aligning the transfer holes 242 with respect to the respective discharge holes 232, or can be blocked by deviating the transfer holes 242 from the respective discharge holes 232.

A transfer tube 244 having passages 246 formed to be connected to the transfer holes 242 may be formed to extend upward inside the rotational body 240. The powder discharged from the discharge holes 232 may be supplied to an upper portion of the transfer tube 244 through the passages 246 of the transfer tube 244, which are connected to the transfer holes 242.

The powder brush 210 may be provided above the rotational body 240. The powder brush 210 may be provided to be inserted into a space between the transfer tube 244 and an inner peripheral surface of the rotational body 240. Thus, the powder may be discharged through the discharge holes 232 and the transfer holes 242, and supplied to the powder brush 210 through the transfer tube 244.

Cam grooves 250 are formed in an outer peripheral surface of the rotational body 240 to be inclined with respect to the axial direction. The cam grooves 250 are portions used when being coupled to the sleeve 260, which will be described later.

In order to ensure the pivotable coupling between the rotational body 240 and the housing 230, a rotational shaft 247 is formed on the lower end of the rotational body 240 to protrude along the central axis. Further, an insertion hole 236 through which the rotational shaft 247 is inserted is formed at the center of the bottom surface of the housing 230. The rotational shaft 247 of the rotational body 240 is inserted into the insertion hole 236 of the housing 230, so that the rotational body 240 is rotatable relative to the housing 230.

In the present embodiment, the rotational shaft 247 may have a recessed portion 248 formed to protrude outward along an outer peripheral surface of the rotational shaft 247, and the insertion hole 236 may have a groove portion 237 formed in an inner peripheral surface thereof so that the depressed portion 248 is locked into the groove portion 237. Thus, when the rotational shaft 247 is fitted to the insertion hole 236, the recessed portion 248 is engaged with the groove portion 237 so that the housing 230 and the rotational body 240 can be coupled to each other in a tighter manner. With this configuration, it is possible to prevent a gap from being generated between the discharge holes 232 formed in the housing 230 and the transfer holes 242 formed in the rotational body 240, thus preventing the powder from leaking out from the housing 230 and the rotational body 240.

Figure 3:
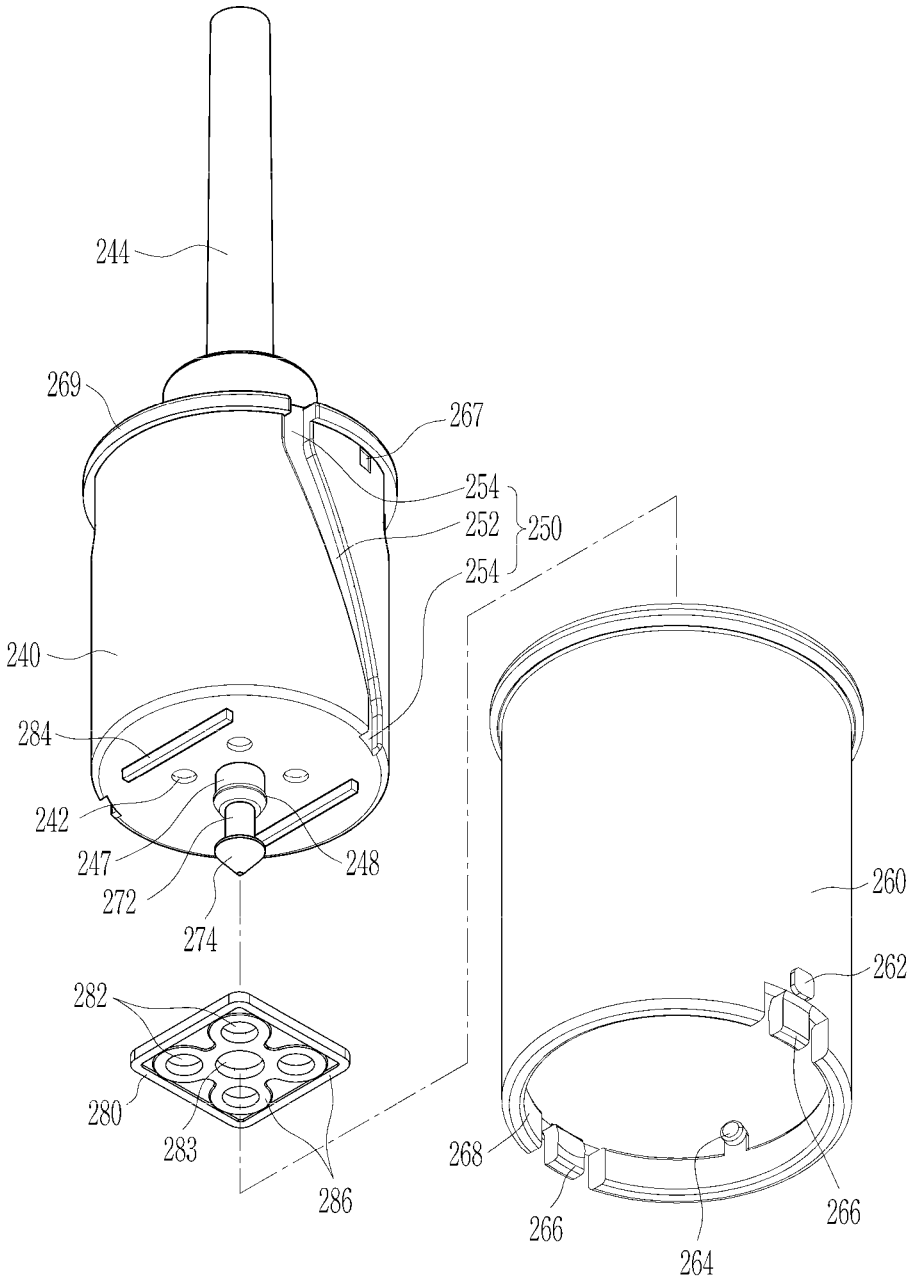
FIG. 3 is a view specifically illustrating a configuration of a portion of the cosmetic container according to the embodiment.

As shown in FIG. 3, in the present embodiment, the cosmetic container 100 may further include a sealing part that is tightly provided between the rotational body 240 and the housing 230 so as to prevent a gap from being generated between the discharge holes 232 and the transfer holes 242.

The sealing part may include a polygonal sealing pad 280 which is coupled to the rotational body 240 by being fitted into the rotational shaft 247, and guide bars 284 formed to protrude from the lower end of the rotational body 240 so as to prevent the rotation of the sealing pad 280. The sealing pad 280 has holes 282 formed at positions corresponding to the transfer holes 242.

When the recessed portion 248 of the rotational shaft 247 is engaged with the groove portion 237 of the housing 230, the sealing pad 280 is elastically pressed between the rotational body 240 and the housing 230 and is brought into close contact with the rotational body 240 and the housing 230. Accordingly, the sealing pad 280 is brought into more close contact with the rotational body 240 and the housing 230, which makes it possible to prevent the generation of the gap between the rotational body 240 and the housing 230.

The sealing pad 280 may be formed of a material different from that of the rotational body 240 or the housing 230. In the present embodiment, the sealing pad 280 may be formed of a material having an excellent elastic force and sealability. For example, the sealing pad 280 may be formed of rubber, urethane or silicon material.

The sealing pad 280 may be a plate-liked structure. A hole 283 into which the rotational shaft 247 of the rotational body 240 is inserted is formed at the center of the sealing pad 280. The holes 282 are circumferentially arranged about the hole 283.

The sealing pad 280 may be coupled to the lower end of the rotational body 240 by being fitted to the rotational shaft 247 of the rotational body 240. The sealing pad 280 may have a polygonal shape such as rectangular and may be fixed by the guide bars 284 such that it is not freely rotated with respect to the rotational body 240 but is movable together with the rotational body 240.

The guide bars 284 which correspond in size to the sealing pad 280 are formed to protrude from the lower end of the rotational body 240, and support lateral ends of the sealing pad 280. The sealing pad 280 is supported by the guide bars 284 in a state in which the holes 282 formed in the surface of the sealing pad 280 are aligned with the transfer holes 242 of the rotational body 240.

The sealing pad 280 of the present embodiment may include a flesh portion 286 formed to have an increased thickness in the peripheral portion of the sealing pad 280 or the surrounding of the hole 283 and the holes 282. Thus, the sealing pad 280 may be brought into tight contact with the surfaces of the rotational body 240 and the housing 230 through the flesh portion 286. Accordingly, the surrounding of the hole 283 and the holes 282, or the peripheral portion of the sealing pad 280 in which gap may be generated, can be further pressed by the flesh portion 286 of the sealing pad 280, thus increasing tightness.

A filter 270 configured to filter the powder to be discharged through the discharge holes 232 may be further provided outside the bottom surface of the housing 230.

The filter 270 may be a porous foam structure with open cells formed therein, which has a predetermined thickness. The filter 270 may be formed to have a size enough to cover the entire discharge holes 232. Thus, the powder of a certain amount can be supplied to the brush part 200 through the filter 270 via the discharge holes 232 in the form of a powder of a constant size without being agglomerated.

In the present embodiment, the filter 270 may be replaced with various kinds of ones depending on the viscosity or the like of the powder accommodated in the cosmetic container. For example, in a case where the viscosity of the powder is low, a filter having small porous open cells may be mounted and used instead of the filter 270.

The filter 270 may be positioned under the housing 230 by being engaged into a fitting bar 272 which is formed to extend from the lower end of the rotational body 240. That is, the fitting bar 272 may be formed on the tip of the rotational shaft 247 of the rotational body 240 to extend inward the housing 230 through the insertion hole 236 of the housing 230 and to secure the filter 270. The fitting bar 272 may include a conical protrusion 274 of a wedge-like shape which is integrally formed on the leading end of the fitting bar 272 and passes through a hole formed in the center of the filter 270. A dick-shaped stopper 276 may be engaged with and coupled to the conical protrusion 274 to prevent the filter 270 from being separated from the fitting bar 272.

The conical protrusion 274 of the fitting bar 272 may be forcibly fitted into a hole formed in the center of the stopper 276. The stopper 276 is locked to the conical protrusion 274 and fixed to the fitting bar 272. The stopper 276 is a member having a relatively larger diameter than that of the hole formed in the center of the filter 270. Thus, the filter 270 is prevented from being dropped down from the fitting bar 272 by being locked to the stopper 276.

If necessary, the filter 270 may be easily replaced with a new one by separating the stopper 276 and the filter 270 from the fitting bar 272, installing the new filter on the fitting bar 272 and fixing the stopper 276.

As described above, it is possible to easily replace the filter with a new one if necessary, thus optimally adjusting an amount of the powder to be discharged.

In some embodiments, although not shown herein, the filter may be a single layer of sheet structure with grid-like patterns formed therein. In such a structure, the powder does not exist on the filter in the course of filtering the powder. This makes it possible to minimize coagulating of the powder remaining on the filter or sticking of the remaining powder on the filter.

The sleeve 260 is provided between the rotational body 240 and the housing 230.

The sleeve 260 is a cylindrical structure with upper and lower ends opened, and is provided to be movable upward and downward along the axial direction relative to the housing 230. The powder brush 210 may be gathered as the sleeve 260 slides upward relative to the housing 230. The powder brush 210 may be expanded to become a usable state as the sleeve 260 slides downward relative to the housing 230. In addition, the sleeve 260 moves upward and downward relative to the housing 230 while being operatively coupled between the housing 230 and the rotational body 240. The discharge holes 232 and the transfer holes 242 may be in selective communication with each other by rotating the rotational body 240 clockwise or counterclockwise.

That is, the opening/closing part 220 of the present embodiment enables the transfer holes 242 and the discharge holes 232 to be in communication with each other or to be disconnected from each other without additional operations by moving the sleeve 260 upward or downward.

Figure 4:
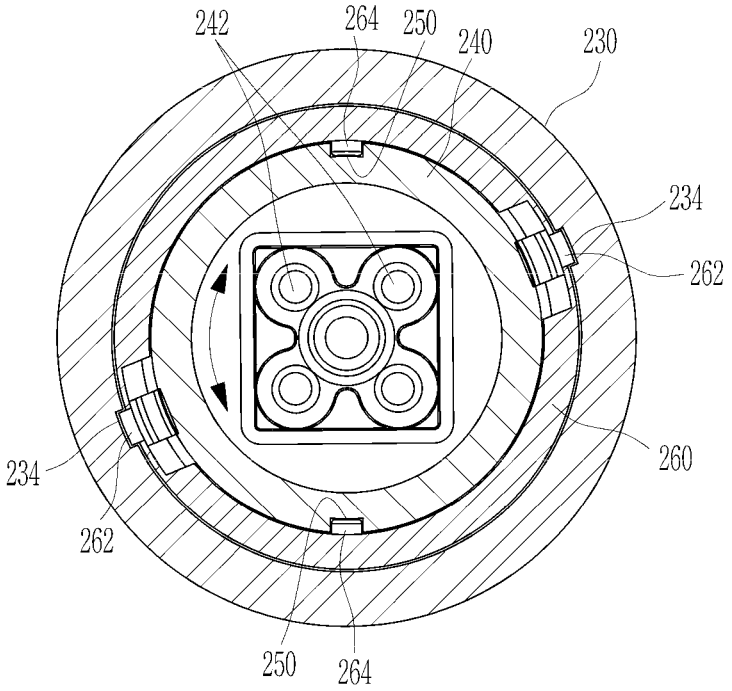
FIG. 4 is a schematic cross-sectional view illustrating a configuration of an opening/closing part of the cosmetic container according to the embodiment.

As shown in FIG. 4, in the present embodiment, the vertical grooves 234 may be formed in the inner peripheral surface of the housing 230, and outwardly-protruded protrusions 262 may be formed in the outer peripheral surface of the sleeve 260 so as to be engaged with the respective vertical grooves 234. The vertical grooves 234 are formed to continuously extend from the upper end of the housing 230 to the lower end thereof along the axial direction. At least one or more vertical grooves 234 may be formed in the inner peripheral surfaces of the housing 230. In the present embodiment, the two vertical grooves 234 are arranged in a 180-degree rotationally symmetric manner. The protrusions 262 are formed to protrude outward from the outer peripheral surface of the sleeve 260 at positions corresponding to the vertical grooves 234. The protrusions 262 may be formed in the lower portion of the sleeve 260.

The protrusions 262 are fitted into the respective vertical grooves 234 so that the rotation of the sleeve 260 relative to the housing 230 is restricted. Thus, the sleeve 260 can be merely moved upward and downward along the vertical grooves 234 without rotating relative to the housing 230.

Although in the present embodiment, the configuration in which the vertical grooves 234 and the protrusions 262 are formed in the housing 230 and the sleeve 260, respectively, has been described, the present disclosure is not limited thereto and is also applicable to the counter configuration. For example, the vertical grooves 234 may be formed in the outer peripheral surface of the sleeve 260 and the protrusions 262 may be formed in the inner peripheral surface of the housing 230 such that the vertical grooves 234 and the protrusions 262 are engaged with each other.

Figure 5:
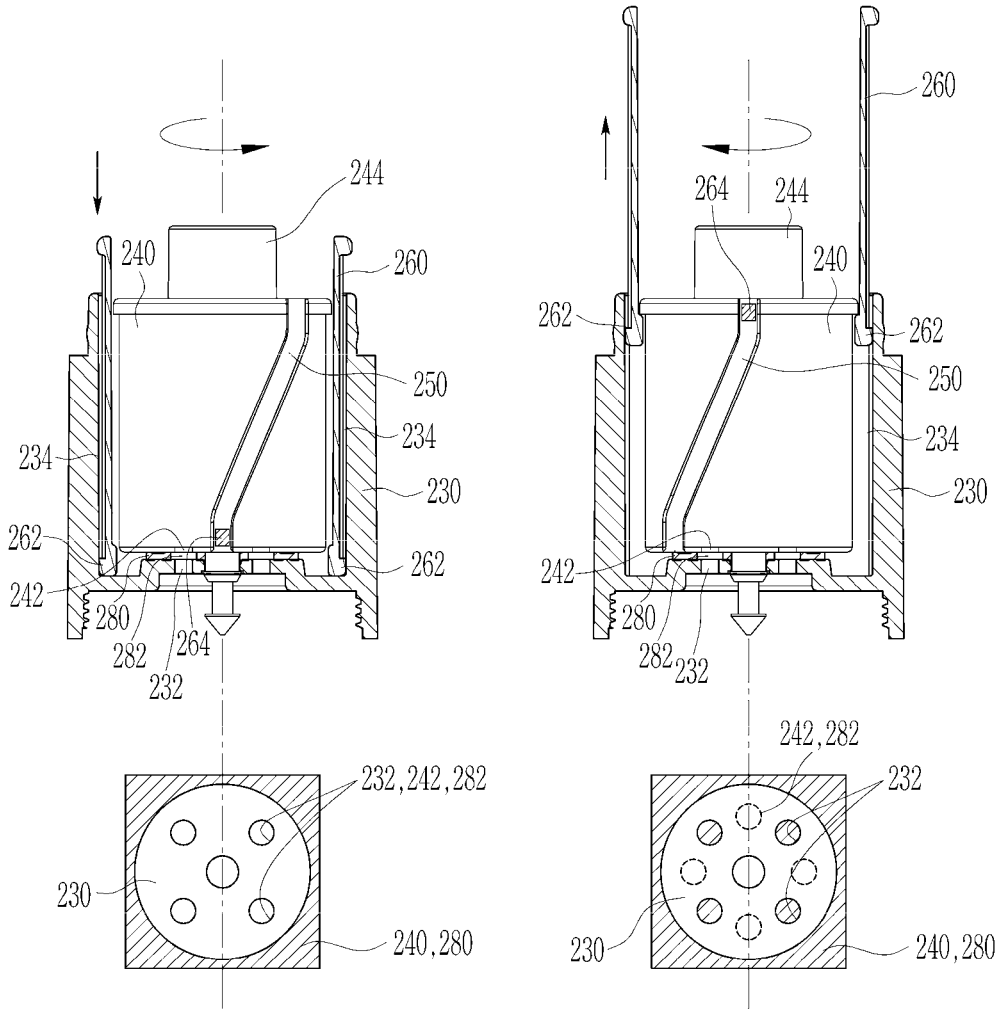
FIG. 5 is a schematic view for explaining an operation of the opening/closing part of the cosmetic container according to the embodiment.

The coupling configuration between the rotational body 240 and the sleeve 260 will be described. As shown in FIGS. 4 and 5, the cam grooves 250 may be formed in the outer peripheral surface of the rotational body 240, and cam protrusions 264 may be formed in the inner peripheral surface of the sleeve 260 to be engaged with the respective cam grooves 250.

Each of the cam grooves 250 is formed to continuously extend from the upper end of the rotational body 240 to the lower end thereof in the axial direction. At least one of more cam grooves 250 may be formed in the outer peripheral surface of the rotational body 240. In the present embodiment, the two cam grooves 250 are arranged in a 180-degree rotationally symmetric manner.

Each of the cam grooves 250 extends in the axial direction and may be formed obliquely with respect to the axial direction such that both ends of each cam groove 250 are positionally deviated from each other along the circumferential direction. Thus, when the sleeve 260 slides upward and downward, the cam protrusions 264 of the sleeve 260 are moved upward and downward along the respective cam grooves 250 so that the rotational body 240 rotates clockwise and counterclockwise relative to the sleeve 260.

Instead of the above-described configuration, the present disclosure is also applicable to a configuration in which the cam grooves 250 are formed in the inner peripheral surface of the sleeve 260 and the cam protrusions 264 are formed in the outer peripheral surface of the rotational body 240. With such a configuration, when the sleeve 260 moves upward and downward, the rotational body 240 can be rotated clockwise and counterclockwise along the cam grooves 250 by allowing the cam protrusions 264 to be engaged with the respective cam grooves 250.

In the present embodiment, each cam groove 250 may include an inclined portion 252 formed obliquely with respect to the axial direction, and linear portions 254 which extend along the axial direction from the inclined portion 252 to constitute both end portions of the cam groove 250. The inclined portion 252 and the linear portions 254 are formed integrally with each other to constitute one cam groove 250. With this configuration, the rotational body 240 is rotationally moved when the cam protrusion 264 passes through the inclined portion 252 of each cam groove 250, while the rotational body 240 is stopped and only the sleeve 260 may move upward and downward when the cam protrusion 264 passes through the linear portions 254 of each cam groove 250.

As described above, by forming the linear portions 254 at both ends of the inclined portion 252, it becomes possible to accurately set the rotational position of the rotational body 240. That is, when the cam protrusion 264 reaches the linear portion 254 of the cam groove 250, the rotational body 240 is no longer rotated even if the sleeve 260 is moved upward and downward. Thus, the rotational body 240 can be rotated to a set position and maintained in a state available after the rotation, regardless of a difference in level of the upward/downward movement of the sleeve 260. This makes it possible to accurately perform the opening and closing of the discharge holes 232.

Instead of the configuration described above, a configuration in which each cam groove 250 is formed in a spiral shape as a whole along the axial direction may be employed. With this configuration, the rotational body 240 having the cam grooves 250 formed therein can be spirally rotated clockwise and counterclockwise relative to the sleeve 260 when the cam protrusions 264 pass through the cam grooves 250, thus opening and closing the discharge holes 232.

In the present embodiment, when the sleeve 260 is moved downward, the powder brush 210 is exposed and the discharge holes 232 are opened to be brought into a usable state. Meanwhile, when the sleeve 260 is moved upward, the sleeve 260 surrounds the powder brush 210 to protect the powder brush 210 and the discharge holes 232 are blocked to cutoff the discharge of the powder.

As shown in FIG. 3, the sleeve 260 may further include elastic pieces 266 formed in the lower portion thereof. Lock pockets 267 may be further formed in the upper portion of the rotational body 240 such that the elastic pieces 266 are locked into the respective lock pockets 267. Each of the elastic pieces 266 may be formed in a slit formed by cutting a portion of the leading end of the sleeve 260 and may be brought into close contact with the rotational body 240 in an elastic manner.

The lock pockets 267 are formed at positions corresponding to the elastic pieces 266 in the rotational body 240 so that the elastic pieces 266 can be locked into the respective lock pockets 267 when the sleeve 260 is raised to the highest position.

Thus, the sleeve 260 can be moved upward and downward while being brought into close resilient contact with the rotational body 240 by the elastic pieces 266. Further, when the sleeve 260 is raised to the highest position, the elastic pieces 266 are locked into the respective lock pockets 267 so that the sleeve 260 is fixed to the rotational body 240. Thus, the sleeve 260 can be fixed to the rotational body 240 in the state where the sleeve 260 has been moved upward. Further, when the cosmetic container is not in use, it becomes possible to stably maintain the state in which the discharge holes 232 are blocked, which is obtained with the upward movement of the sleeve 260.

In addition, a stepped portion 268 may be formed on an inner peripheral surface of the lower end of the sleeve 260. A flange 269 may be formed to protrude outward from an outer peripheral surface of the upper end of the rotational body 240 which is inserted into the sleeve 260. Thus, when the sleeve 260 is moved upward, the stepped portion 268 of the sleeve 260 is locked to the flange 269 of the rotational body 240, which makes it possible to prevent the sleeve 260 from being detached from the rotational body 240.

FIG. 5 illustrates the opening/closing state of the discharge holes with the upward/downward movement of the sleeve.

As shown in FIG. 5, with the upward/downward movement of the sleeve 260, the rotational body 240 is rotated clockwise and counterclockwise so that the discharge holes 236 are opened and closed.

The sleeve 260 can be moved only upward and downward relative to the housing 230 staying in a fixed state because the protrusions 262 are locked into the vertical grooves 234. Further, the sleeve 260 is coupled to the rotational body 240 through the cam grooves 250 and the cam protrusions 264. The rotational body 240 is not moved upward and downward relative to the housing 230 but is rotatably coupled to the housing 230. Thus, the rotational body 240 can be merely rotated with the upward/downward movement of the sleeve 260.

Thus, when the sleeve 260 is moved upward and downward, the rotational body 240 which is engaged with the cam protrusions 264 of the sleeve 260 through the cam grooves 250 is rotated relative to the housing 230. As the rotational body 240 rotates relative to the housing 230 staying in a fixed state, the positions of the transfer holes 242 relative to the discharge holes 232 may be changed to open and close the discharge holes 232.

That is, when the sleeve 260 is moved upward relative to the housing 230, the rotational body 240 is rotated in one direction so that the transfer holes 242 formed in the rotational body 240 are positionally deviated from the discharge holes 232 formed in the housing 230. Thus, the discharge holes 232 are blocked and the discharge of the powder is stopped.

Meanwhile, when the sleeve 260 is moved downward relative to the housing 230, the rotational body 240 is rotated in a direction opposite the one direction. Thus, the transfer holes 242 formed in the rotational body 240 are moved to the positions of the discharge holes 232 formed in the housing 230. That is, the rotational body 240 is rotated relative to the housing 230 staying in a fixed state, and the transfer holes 242 are aligned with the discharge holes 232 so that the transfer holes 242 and the discharge holes 232 are brought into communication with each other. Accordingly, the discharge holes 232 are opened so that the powder can be supplied to the powder brush 210 through the discharge holes 232 and the transfer holes 242.

As described above, the opening/closing part 220 of the present embodiment can open and close the discharge holes 232 by moving the sleeve 260 upward and downward to rotate the rotational body 240. This eliminates the need to perform an additional operation for opening and closing the discharge holes 232, thus improving the usability of the cosmetic container.

Figure 6:
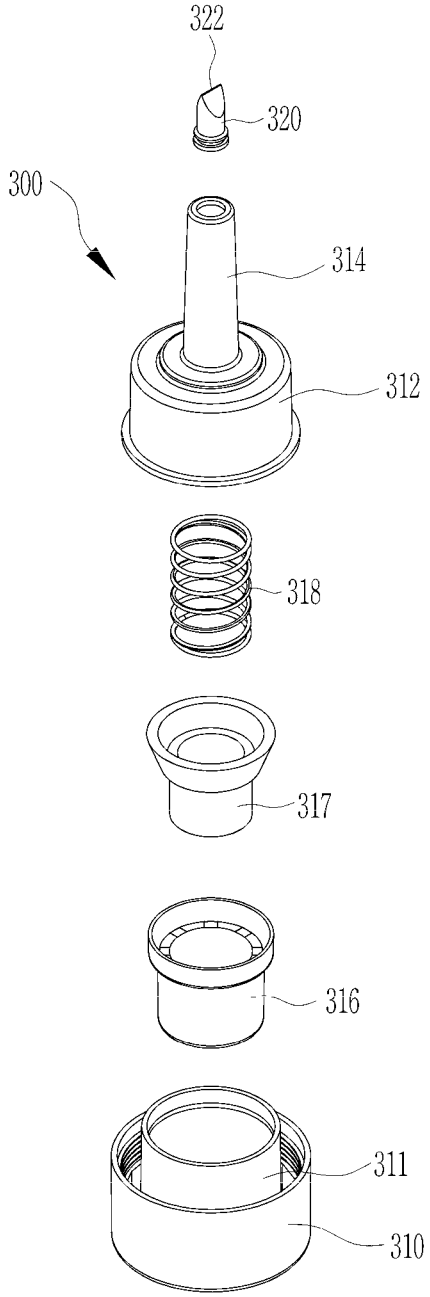
FIG. 6 is a schematic exploded perspective view showing a structure of an air injection part of the cosmetic container according to the embodiment.

FIG. 6 illustrates the configuration of the air injection part according to the present embodiment.

As shown in FIG. 6, the air injection part 300 is installed in the lower end of the container body 110 to inject air toward the discharge holes 232, thereby forcibly injecting the powder into the brush part 200.

The air injection part 300 of the present embodiment may include a holder 310 provided in an opened portion of the lower end of the container body 110, a cover 312 provided in an upper end of the holder 310, an air tube 314, through which air is transferred, formed on the cover 312 to extend toward the upper portion of the container body 110, a button 316 provided in a lower end of the holder 310 to protrude outwardly so that the button 316 can be pressed externally, an elastic member 318 provided between an inner wall 311 of the holder 310 and the button 316 to apply an elastic resilience with respect to the button 316, and a check valve 320 provided on an upper end of the air tube 314 and configured to inject the air into the discharge holes 232 of the container body 110 by being opened and closed by an air pressure of the air tube 314, which is generated with the operation of the button 316.

In addition, the air injection part 300 may further include a piston member 317 provided in the button 316 and having a skirt portion whose outer diameter is increased as it goes upward. The piston member 317 is brought into close contact with an inner peripheral surface of the holder 310 in an elastic manner.

The holder 310 may be detachably coupled to the lower end of the container body 110. For example, a male screw and a female thread may be formed in the lower end of the container body 110 and the lower end of the holder 310, respectively, so that the container body 110 and the holder 310 are threadedly coupled to each other.

The cover 312 is coupled to the upper end of the holder 310. The cover 312 can cover the holder 310 to hermetically seal a space inward of the cover 312. The air tube 314 is integrally formed on the upper end of the cover 312. The air tube 314 is in communication with an internal space of the holder 310 and extends vertically toward the discharge holes. Thus, when the button 316 is pressed, the air in the space inward of the cover 312 can be injected toward the discharge holes through the air tube 314.

A hole is formed in the lower end of the holder 310. The holder 310 can be coupled with the button 316 through the hole. The inner wall 311 of a cylindrical shape may be formed inside the holder 310. The piston member 317 is brought into close contact with the inner wall 311. The button 316 is installed to protrude outward through the hole of the holder 310 while being fitted to the holder 310. The piston member 317 is provided inside the button 316 and is moved together with the button 316. The piston member 317 has the skirt portion whose diameter is gradually increased as it goes upward, so that the piston member 317 is brought into close contact with the inner wall 311 of the holder 310. The piston member 317 may be formed of an elastic material such as rubber, silicon or the like.

Thus, when the button 316 is pressed, the skirt portion of the piston member 317 is brought into close contact with the inner wall 311 of the holder 310 so that the air in the internal space of the holder 310 is pushed out forcibly toward the air tube 314.

The elastic member 318 is inserted into the internal space of the holder 310 so that the button 316 and the cover 312 are coupled to each other in a resilient manner. Thus, when the button 316 is pressed, the elastic member 318 is elastically compressed to apply an elastic resilience with respect to the button 316. As a result, the button 316 returns to its original state.

The check valve 320 is provided at the tip of the air tube 314.

The check valve 320 is a valve 320 configured to convey fluid only in one direction. The check valve 320 can convey the fluid from the air tube 314 toward the discharge holes 232. However, the conveyance of the fluid in a direction opposite the one direction in the check valve 320 is blocked. Thus, the air is injected toward the discharge holes by the check valve 320, whereas the powder does not flow into the air tube 314 through the check valve 320.

In the present embodiment, the check valve 320 is formed of an elastic material. The check valve 320 may be configured as follows. A lower end of the check valve 320 is opened to be in communication with the air tube 314. The check valve 320 is formed in a conical shape having both membranes which are gradually reduced in thickness as they are directed upward. A cut line 322 of a slit shape is formed in an upper end of the check valve 320 as the tip. The both membranes are in contact with each other through the cut line 322.

The check valve 320 may be formed of an elastically deformable material. For example, the check valve 320 may be formed of a material such as rubber, silicon, resin or the like. The check back 320 itself has elasticity. Thus, in a state where the check valve 320 is elastically deformed due to an external pressure, if such an external force is released, the check valve 320 can be returned to the origin state by virtue of its own resilience.

The check valve 320 is opened and closed according to a change in internal pressure through the air tube 314 to discharge the air in one direction. That is, when the button 316 is pressed, the internal pressure of the holder 310 is increased and the cut line 322 in the tip of the check valve 320 is expanded and opened. Thus, the air is injected from the air tube 314 toward the discharge holes 232 of the housing 230 through the check valve 320.

Meanwhile, if the external force acting on the button 316 is released, the button 316 returns to the original state and the pressure of the air tube 314 is reduced. As a result, the cut line 322 in the tip of the check valve 320 is contracted and closed. This prevents the powder outside the check valve 320 from flowing into the air tube 314.

As described above, by injecting the air toward the discharge holes 232 with a simplified configuration, it is possible to discharge and use the powder inside the container body 110 to the powder brush 210 through the discharge holes 232 in a smoother manner.

FIGS. 8 to 12 illustrate a cosmetic container provided with an air injection part according to another embodiment.

Other configurations are the same as those described above except for the structure of the air injection part in the cosmetic container of the above embodiment. Accordingly, in the following description, the same configurations as those of the above embodiment will be designated by like reference numerals with detailed descriptions thereof omitted.

The structure of the air injection part will be described below with reference to FIGS. 8 to 12.

As shown in figures, an air injection part 300 is installed at the lower end of the container body 110 to inject air toward the discharge holes 232, thereby forcibly injecting the powder into the brush part 200.

The air injection part 300 of this embodiment may include a holder 310, a button 320, and a pumping member 330.

The holder 310 is installed at the lower end of the container body 110. The holder 310 may be detachably coupled to the lower end of the container body 110. For example, a male screw and a female screw may be formed at the lower end of the container body 110 and the upper end of the holder 310, respectively, so that the container body 110 and the holder 310 are threadedly coupled with each other.

The holder 310 supports the button 320. A hole 312 is formed in the lower end of the holder 310 so that the holder 310 can be engaged with the button 320.

The button 320 has a configuration in which an upper portion is opened and the pumping member 330 is fitted into an internal space of the button 320. The button 320 is coupled with the pumping member 330 inside the holder 310.

The button 320 is fitted into the holder 310 such that the button 320 protrudes outward through the hole 312 of the holder 310. A flange 322 may be formed on an upper portion of the button 320 to protrude outward, so that the flange 322 is locked into the hole 312 and the button 312 is prevented from being separated from the hole 312. Thus, the button 320 is supported by the holder 310 while protruding through the hole 312 of the holder 310. The user can push the button 320 protruding outward of the holder 310 to operate the pumping member 330.

The pumping member 330 is coupled with the button 320 inside the holder 310. The pumping member 330 may be elastically contracted by the button 320 to discharge air in the pumping member 330 through the upper end of the pumping member 330.

The pumping member 330 has an internal space into which air flows. The pumping member 330 is provided between the container body 110 and the button 320 in a resilient manner. The lower end of the pumping member 330 is coupled with the button 320 and the upper end thereof extends toward the discharge holes 232 of the container body 110. The pumping member 330 may be elastically deformed by a pressing force of the button 320 to inject the inner air into the discharge holes 232 of the container body 110.

The pumping member 330 of this embodiment may include an elastic deformation portion 331, an upper pad 332, a lower pad 333, an insertion portion 340, an air tube 334, and a check valve 335, which are formed as a unit. The pumping member 330 has a hollow cylindrical shape. In the pumping member 330, the check valve 335, the air tube 334, the upper pad 332, the elastic deformation portion 331, the lower pad 333, and the insertion portion 340 are continuously connected in that order from above downward.

The pumping member 330 may be formed of, for example, an elastic material, such as rubber, silicon or the like.

The pumping member 330 may be formed of a single body obtained by injecting a resin such as rubber, silicon or the like so that the elastic deformation portion 331, the upper pad 332, the lower pad 333, the insertion portion 340, the air tube 334, and the check valve 335 are connected to one another as a unit.

This makes it possible to reduce the number of components constituting the air injection part 300 as much as possible.

The elastic deformation portion 331 is elastically deformed at the time of pushing the button 320 and releasing the pushing operation so that the inner air is pressurized and is discharged through the check valve 335 in the tip of the air injection part 300. The elastic deformation portion 331 is compressed with the pushing operation of the button 320, and is elastically returned to its origin state when the external force acting on the button 320 is released. The button 320 that has been pushed by virtue of the elastic force of the elastic deformation portion 331 can be returned to its original state by protruding outward of the holder 310.

That is, the elastic deformation portion 331 performs the operation of discharging the air to the outside and the operation of applying the elastic force for returning the button 320 to the original position by applying a pressure with respect to the interior of the pumping member 330.

Figure 10:
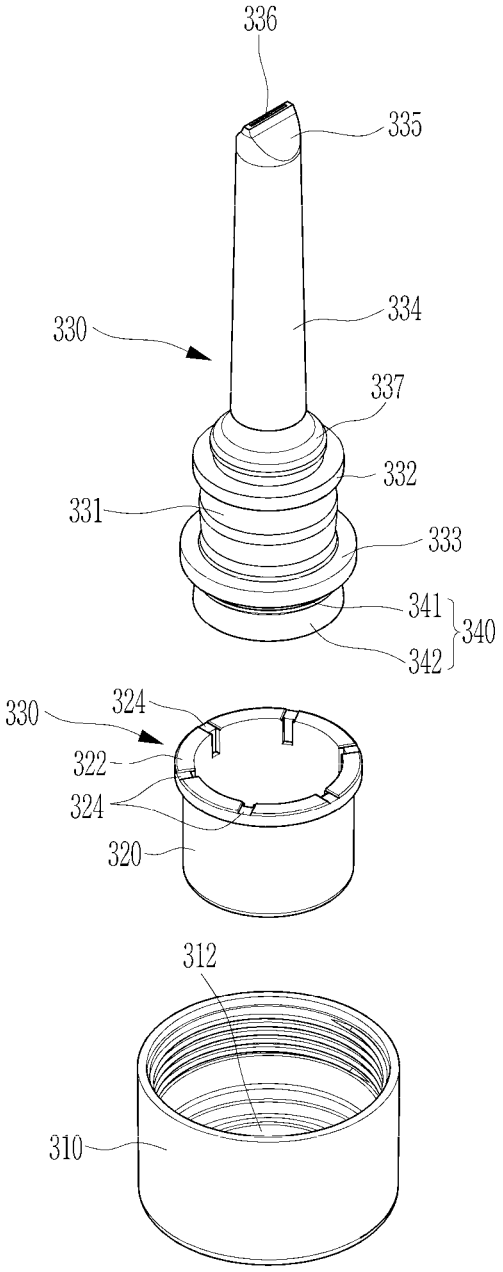
FIG. 10 is a schematic exploded perspective view illustrating a configuration of an air injection part of the cosmetic container according to the embodiment of FIG. 8.

As shown in FIG. 10, the elastic deformation portion 331 of the present embodiment may be configured to be bent in an outwardly convex shape for smooth deformation. In addition to the above-described configuration, the elastic deformation portion 331 may be configured in a bellows shape having overlapped creases. The elastic deformation portion 331 may have any shape as long as the elastic deformation portion 331 can be compressed in an elastic manner and returned to its original shape.

The upper pad 332 and the lower pad 333 are formed on the upper portion and the lower portion of the elastic deformation portion 331, respectively The upper pad 332 may be integrally formed on the upper portion of the elastic deformation portion 331 to protrude outward so that the upper pad 332 is brought into close contact with an inner flange 338 formed on an inner surface of the container body 110.

The lower pad 333 may be integrally formed on the lower portion of the elastic deformation portion 331 to protrude outward so that the lower pad 333 is brought into close contact with the upper end of the button 320.

The upper pad 332 and the lower pad 333 are brought into close contact with the inner flange 338 of the container body 110 and the button 320 at a predetermined pressure, respectively, by virtue of the elastic force of the elastic deformation portion 331, in the state in which the holder 310 is fastened to the lower end of the container body 110.

In this embodiment, a distance between the upper pad 332 and the lower pad 333 may be larger than that between the inner flange 338 and the upper end of the button 320 in a state in which the button 320 is not pushed. Thus, when the holder 310 is completely fastened to the lower end of the container body 110, the upper pad 332 and the lower pad 333 are pressed by the inner flange 338 and the button 320, respectively. Accordingly, the elastic deformation portion 331 formed between the upper pad 332 and the lower pad 333 is pressed and elastically deformed so that the elastic force is applied to the upper pad 332 and the lower pad 333.

Thus, the upper pad 332 can be brought into close contact with the inner flange 338 at a predetermined pressure. Further, in the state in which the lower pad 333 presses the button 320 at a predetermined pressure, the state in which the button 320 protrudes from the holder 310 can be continuously maintained in a stable manner.

Figure 11:
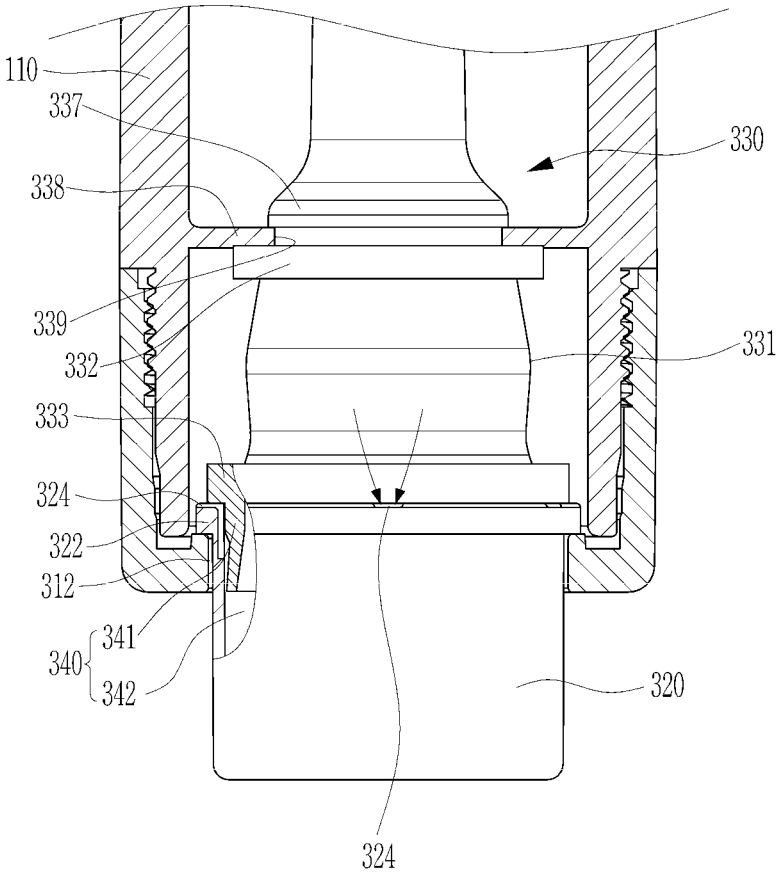
FIG. 11 is a schematic view for explaining an operation of the air injection part of the cosmetic container according to the embodiment of FIG. 8.

As shown in FIG. 11, the inner flange 338 is formed in the container body 110 so as to support the upper pad 332. The inner flange 338 is formed to protrude in a horizontal direction from an inner peripheral surface of the container body 110 toward the center portion thereof. The upper pad 332 is brought into close contact with a lower end of the inner flange 338. The air tube 334 formed above the upper pad 332 passes through a central hole 339 of the inner flange 338.

The inner flange 338 may act as a stopper configured to block the upper pad 332 and prevent the pumping member 330 from moving upward. Further, the inner flange 338 is brought into close contact with the upper pad 332 so that the powder accommodated in the container body 110 is prevented from being discharged to the outside.

As described above, the upper pad 332 remains in close contact with the inner flange 338 at a pressure by virtue of the elastic force of the elastic deformation portion 331. Thus, it is possible to prevent the powder from being discharged to the outside through the gap between the inner flange 338 of the container body 110 and the upper pad 332 even in a state in which the button 320 is not pushed.

In this embodiment, in order to increase airtightness between the inner flange 338 and the pumping member 330, the pumping member 330 may further include a stepped member 337 spaced apart from the upper pad 332 and formed to protrude outward of the air tube 334. The stepped member 337 is brought into close contact with an upper end of the inner flange 338. Thus, the pumping member 330 may be coupled with the inner flange 338 while the inner flange is fitted between the stepped member 337 and the upper pad 332.

By allowing the upper pad 332 to be in close contact with the lower portion of the inner flange 338 and allowing the stepped member 337 to be in close contact with the upper portion of the inner flange 338 with the inner flange 338 interposed between the stepped member 337 and the upper pad 332, the pumping member 330 and the container body 110 are more tightly coupled with each other so that the powder accommodated in the container body 110 can be more effectively prevented from flowing out through the central hole 339 of the inner flange 338.

In order to ensure more tight coupling between the pumping member 330 and the container body 110, an outer diameter of the air tube 334 positioned between the stepped member 337 and the upper pad 332 may be set greater than or equal to an inner diameter of the central hole 339 of the inner flange 338. Further, the gap between the stepped member 337 and the upper pad 332 may be set smaller than or equal to a thickness of the inner flange 338. Thus, the stepped member 337 and the upper pad 332 of the pumping member 330 can be brought into close contact with the inner flange 338 in a more air-tight manner.

An upper end of the stepped member 337 may form an inclined surface whose diameter becomes smaller as it goes upward. This allows the upper inclined surface of the stepped member 337 to easily pass through the central hole 339 of the inner flange 338 in the course of coupling the pumping member 330 to the inner flange 338 of the container body 110. Thus, the stepped member 337 can be easily assembled to the inner flange 338 while passing through the central hole 339 of the inner flange 338.

The air tube 334 is integrally formed on the upper portion of the elastic deformation portion 331. The air tube 334 is formed to extend toward the discharge holes along an axial direction. A length of the air tube 334 may be variously changed depending on a length of the container body 110. The interior of the air tube 334 is in communication with the interior of the elastic deformation portion 331. The air pushed out by the compression of the elastic deformation portion 331 is transferred along the air tube 334. The air transferred inward of the air tube 334 is injected toward the discharge holes through the check valve 335 formed at the tip.

The check valve 335 is integrally formed on the upper end of the air tube 334. The check valve 335 is opened and closed by an internal air pressure so that the air can be injected to only the outside from the interior of the air tube 334.

In this embodiment, the check valve 335 may be formed in a tapered conical shape having both membranes which are gradually reduced in thickness upward, and may have a configuration in which a slit-liked cut line 336 is formed in an upper end of the check valve 335 as a tip portion, and the both membranes are in contact with each other through the cut line 336.

The check valve 335 is a valve configured to convey fluid only in one direction. The check valve 335 can convey the fluid from the air tube 334 toward the discharge holes. However, the conveyance of the fluid in a direction opposite the one direction in the check valve 335 is blocked. Thus, the air is injected toward the discharge holes by the check valve 335, whereas the powder does not flow into the air tube 334 through the check valve 335.

The check valve 335 itself has elasticity. Thus, in a state where the check valve 335 is elastically deformed due to an external pressure, when such an external force is released, the check valve 320 can be returned to the origin state by virtue of its own resilience.

The check valve 335 is opened and closed according to a change in internal pressure through the air tube 334 to discharge the air in one direction.

That is, when the button 320 is pressed, the internal pressure of the button 320 is increased and the cut line 336 in the tip of the check valve 335 is expanded and opened. Thus, the air is injected from the air tube 334 toward the discharge holes 232 of the housing 230 through the check valve 335.

Meanwhile, if the external force acting on the button 320 is released, the button 320 returns to the original state and the pressure of the air tube 334 is reduced. As a result, the cut line 336 in the tip of the check valve 335 is contracted and closed. This prevents the powder outside the check valve 335 from flowing into the air tube 334.

As described above, by injecting the air toward the discharge holes 232 with a simplified configuration, it is possible to discharge and use the powder inside the container body 110 to the powder brush 210 through the discharge holes 232 in a smoother manner.

The insertion portion 340 is integrally formed under the elastic deformation portion 331 to be in communication with the interior of the elastic deformation portion 331. The insertion portion 340 extends downward from the lower pad 333 and has a cylindrical shape with its lower end opened. The insertion portion 340 is inserted into the button 320 and is brought into close contact with an inner peripheral surface of the button 320 in an elastic manner.

The insertion portion 340 may include a fitting portion 341 that is fitted to the button 320, and a skirt portion 342 formed to extend downward from the fitting portion 341. The skirt portion 342 may be configured so that diameter becomes larger downward.

The skirt portion 342 is brought into close contact with the inner surface of the button 320 to prevent the inner air from escaping through a gap between the insertion portion 340 and the button 320. Further, the skirt portion 342 is elastically deformed such that an external air flows into the button 320 through a gap between the skirt portion 342 and the button 320.

When the internal pressure of the pumping member 330 is relatively larger than the external pressure, the skirt portion 342 may be brought into close contact with the inner surface of the button 320 in a tighter manner while being expanded outward.

Thus, in the course of pushing the button 320 to compress the elastic deformation portion 331 of the pumping member 330, the skirt portion 342 is brought into close contact with the button 320 so that the air inside the pumping member 330 is hard to escape to the outside through a gap between the button 320 and the skirt portion 342.

Meanwhile, when the internal pressure of the pumping member 330 is relatively smaller than the external pressure, the skirt portion 342 is pulled inward so that the external air can be introduced into the pumping member 330 through the gap between the inner surface of the button 320 and the skirt portion 342.

Thus, the elastic deformation portion 331 is compressed so that the inner air is discharged through the check valve 335. In this state, when the elastic deformation portion 331 returns to its origin state, the external air flows into the pumping member 330 through the gap between the insertion portion 340 and the button 320 and the interior of the pumping member 330 can be filled with the external air again.

In a case the external air does not flow smoothly into the pumping member 330, the elastic deformation portion 331 does not return to its original state so that the operation of the air injection part 300 may not be smoothly performed.

This embodiment provides a configuration in which the external air is introduced into the pumping member 330 in a smoother manner. To this end, the button 320 of this embodiment may include at least one or more trench grooves 324 formed in an upper end of the button 320, which is in contact with the lower pad 333 of the pumping member 330.

The trench grooves 324 may be formed to be concave in an upper surface of the flange 322 of the button 320, which is in contact with the lower pad 333. The trench grooves 324 may act as passages through which air flows through gaps formed between the trench grooves 324 and the lower pad 333.

The trench grooves 324 may be formed at intervals along the flange 322 of the button 320. The number of the formed trench grooves 324 may be variously changed.

Further, the trench grooves 324 may be formed to extend along the inner peripheral surface of the button 320 at the upper portion of the button 320. Thus, clearances may be formed in the inner peripheral surface of the button 320 between the insertion portion 340 and the button 320. With this configuration, the external air may be introduced into the pumping member 330 in a smoother manner through the trench grooves 324 between the insertion portion 340 and the button 320.

In this embodiment, the trench grooves 324 may be formed at a position higher than the lower end of the skirt portion 342. Thus, gaps are not formed between the lower end of the skirt portion 342 and the inner peripheral surface of the button 320 by the trench grooves 324. Thus, the external air is easily introduced into the pumping member 330 through the trench grooves 324, whereas the air inside the pumping member 330 is still not discharged to the outside through the gap between the button 320 and the insertion portion 340.

As described above, the air injection part of the present embodiment is provided with the pumping member 330 that constitutes a single member. This makes it possible to perform an air injection operation in a more effective manner with an extremely simplified configuration.

Figure 12:
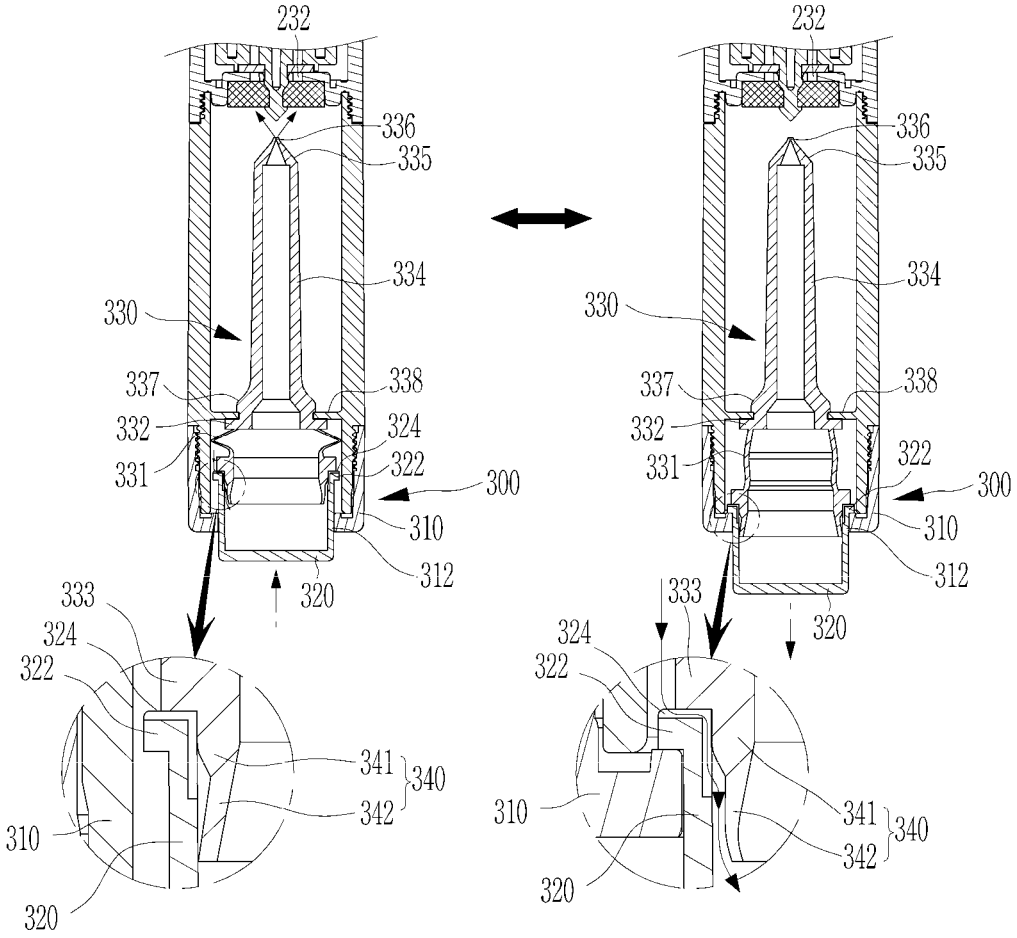
FIG. 12 is a schematic view illustrating an operation state in which the air injection part of the cosmetic container according to the embodiment of FIG. 8 is operated.

FIG. 12 illustrates an operation state of the air injection part according to the present embodiment.

As shown in FIG. 12, when the button 320 is pushed, the lower pad 333 is pressed and raised, and the elastic deformation portion 331 of the pumping member 330 is elastically compressed. As a result, the internal air pressure of pumping member 330 is increased and the skirt portion 342 is expanded outward to be brought into close contact with the inner surface of the push button 320.

Since the skirt portion 342 is brought into close contact with the button 320, the air inside the pumping member 320 does not escape to the outside through the trench grooves 324 formed in the button 320.

The cut line 336 of the check valve 335 is expanded as the internal pressure of the pumping member 330 increases. Thus, the inner air of the pumping member 330 can be injected to the outside through the cut line 336.

The inner air of the pumping member 330 is injected toward the discharge holes 232 through the cut line 336, whereby the powder accommodated in the container body 110 can be easily discharged through the discharge holes 232 together with the air.

As described above, in the course of compressing the pumping member 330 to inject the air, the button 320 and the insertion portion 340 can remain in tight close contact with each other, and the air can be injected only through the cut line 336 of the check valve 335.

Meanwhile, when the external force acting on the button 320 is released, the elastic deformation portion 331 that remains compressed is returned to its original state by virtue of the elastic resilience. The button 330 also protrudes outward of the holder 310 by the elastic force of the elastic deformation portion 331.

The internal pressure of the elastic member 330 is reduced as the elastic deformation portion 331 is returned to its original state. As a result, the cut line 336 of the check valve 335 is contracted and closed. This prevents the powder accommodated in the container body 110 from flowing into the pumping member 330 through the cut line 336.

Subsequently, the internal pressure of the pumping member 330 becomes lower than an external pressure. As a result, the external air is introduced into the pumping member 330 through the trench groove 324 due to such an air pressure difference.

Due to the air pressure difference, gap is generated between the skirt portion 342 and the inner surface of the button 320. The external air can be smoothly introduced into the pumping member 330 through the gap.

The elastic deformation portion 331 of the pumping member 330 is elastically expanded in this manner so that the button 320 is returned to its original position and a new air is caused to be introduced into the pumping member 330, thereby preparing a subsequent pumping operation.

While exemplary embodiments of the present disclosure have been illustrated and described as described above, various modifications and other embodiments may be made by those skilled in the art. Such modifications and other embodiments are all contemplated and included in the appended claims without departing from the spirit and scope of the present disclosure.

EXPLANATION OF REFERENCE NUMERALS

| | |
|---|---|
| 100: cosmetic container | 110, 120: container body |
| 200: brush part | 210: powder brush |
| 220: opening/closing part | 230: housing |
| 232: discharge hole | 234: vertical groove |
| 236: insertion hole | 237: groove portion |
| 240: rotational body | 242: transfer hole |
| 244: transfer tube | 246: passage |
| 247: rotational shaft | 248: recessed portion |
| 250: cam groove | 252: inclined portion |
| 254: linear portion | 260: sleeve |

-continued

| | |
|---|---|
| 262: protrusion | 264: cam protrusion |
| 268: stepped portion | 269: flange |
| 270: filter | 272: fitting bar |
| 274: conical protrusion | 276: stopper |
| 280: sealing pad | 282: hole |
| 284: guide bar | 286: flesh portion |
| 300: air injection part | 310: holder |
| 312: cover | 314: air tube |
| 316: button | 318: elastic member |
| 320: check valve | 322: cut line |
| 320: button | 322: flange |
| 324: trench groove | 330: pumping member |
| 331: elastic deformation portion | 332: upper pad |
| 333: lower pad | 334: air tube |
| 335: check valve | 336: cut line |
| 337: stepped portion | 338: inner flange |
| 340: insertion portion | 341: fitting portion |
| 342: skirt portion | |

What is claimed is:

1. A cosmetic container comprising:

a container body in which a powder is accommodated; and a brush part coupled to an upper end of the container body, and including an opening/closing part provided therein to selectively discharge the powder and a powder brush provided in an upper end of the brush part, wherein the opening/closing part includes:

a housing coupled to the upper end of the container body so as to constitute an outer shape of the cosmetic container and having at least one or more discharge holes, through which the powder is discharged, formed in a lower end of the housing along a circumferential direction with respect to a central axis;

a rotational body rotatably provided inside the housing while being coaxially coupled to the housing, having transfer holes formed at a lower end of the rotational body, wherein the powder brush is provided at an upper end of the rotational body, the powder is supplied into the powder brush through the transfer holes which are in communication with the discharge holes, and the rotational body configured to rotate relative to the housing so that the transfer holes and the discharge holes are in a selective communication with each other or positionally deviated from each other;

a sleeve provided between the housing and the rotational body to slidably move upward and downward relative to the housing, wherein the rotational body is rotated clockwise and counterclockwise with the upward and downward movement of the sleeve, and the discharge holes and the transfer holes are brought into the selective communication with each other with the upward/downward movement of the sleeve; and cam grooves and cam protrusions formed between an outer peripheral surface of the rotational body and an inner peripheral surface of the sleeve so as to face each other and be engaged with each other, wherein the cam protrusions configured to move along the cam grooves, the cam grooves are formed to extend in the axial direction and are formed obliquely with respect to the axial direction to deviate both leading ends of each of the cam grooves from each other in a circumferential direction, so that the rotational body is rotated in the circumferential direction with the upward/downward movement of the sleeve.

2. The cosmetic container of claim 1, further comprises: a filter provided below the discharge holes of the housing and configured to filter the powder to be discharged through the discharge holes, wherein the filter is a single sheet structure with a grid-like pattern.

3. The cosmetic container of claim 1, further comprises: a sealing part tightly provided between the rotational body and the housing so as to prevent a gap from being generated between the discharge holes and the transfer holes, wherein the sealing part includes a polygonal sealing pad coupled to the rotational body by being inserted to a rotational shaft and having holes formed at positions corresponding to the transfer holes, and guide bars formed to protrude from the lower end of the rotational body and configured to restrict a rotation of the sealing pad.

4. The cosmetic container of claim 3, wherein the sealing pad has a flesh portion formed to have an increased thickness in a peripheral portion of the sealing pad or around the holes, so that the sealing pad is brought into tight contact with surfaces of the rotational body and the housing through the flesh portion.

5. The cosmetic container of claim 1, wherein the opening/closing part further includes:

vertical grooves and protrusions formed between an inner peripheral surface of the housing and an outer peripheral surface of the sleeve so as to face each other and be engaged with each other, wherein the protrusions configured to move along the vertical grooves;

wherein the vertical grooves are formed to linearly extend along an axial direction so that the sleeve is vertically moved upward and downward relative to the housing.

6. The cosmetic container of claim 5, wherein each of the cam grooves includes an inclined portion formed obliquely with respect to the axial direction, and linear portions extending from the inclined portion in the axial direction to constitute the both leading ends of each of the cam grooves.

7. The cosmetic container of claim 5, further comprises:

an air injection part provided in a lower end of the container body to forcibly inject the powder into the brush part, wherein the air injection part includes:

a holder provided in an opened portion of the lower end of the container body;

a cover provided on an upper end of the holder;

an air tube, through which air is transferred, formed on the cover to extend toward an upper portion of the container body;

a button provided at a lower end of an inner wall of the holder to protrude outwardly so that the button is pressed externally;

an elastic member provided between an inner wall of the holder and the button to apply an elastic resilience with respect to the button; and a check valve provided at an upper end of the air tube and configured to inject the air toward the discharge holes of the container body by being opened and closed by an air pressure, generated with the operation of the button, in the air tube.

8. The cosmetic container of claim 7, wherein the check valve is formed of an elastic material, a lower end of the check valve is opened to be in communication with the air tube, the check valve is formed in a tapered conical shape having both membranes gradually reduced in thickness upward, having a configuration in which a slit-liked cut line is formed in an upper end of the check valve as a tip portion, and the both membranes are in contact with each other through the cut line.

* * * * *